United States Patent [19]

Anacker

[11] 3,967,562

[45] July 6, 1976

[54] MULTI PURPOSE TABLE

[76] Inventor: Charles D. Anacker, 502 Frenchman St., New Orleans, La. 70116

[22] Filed: Nov. 27, 1974

[21] Appl. No.: 527,824

[52] U.S. Cl. ..... 108/12; 108/144

[51] Int. Cl.[2] ..... A47B 9/00; A47B 85/00

[58] Field of Search ..... 108/12, 11, 13, 16, 108/144, 116, 15; 297/3; 16/163

[56] References Cited

UNITED STATES PATENTS

| | | | |
|---|---|---|---|
| 236,124 | 12/1880 | Washburn | 16/163 X |
| 2,263,921 | 11/1941 | Gipson | 108/12 |
| 2,602,011 | 6/1952 | Sanders | 108/12 |
| 2,635,023 | 4/1953 | Frye | 108/12 X |
| 2,666,681 | 1/1954 | Adler | 108/12 |
| 3,361,088 | 1/1968 | Hodgkin | 108/12 |
| 3,433,183 | 3/1969 | Yarme et al. | 108/12 |
| 3,744,845 | 7/1973 | Sooker | 108/12 X |

FOREIGN PATENTS OR APPLICATIONS

| | | | |
|---|---|---|---|
| 219,788 | 2/1962 | Austria | 108/12 |
| 990,604 | 9/1951 | France | 108/12 |

*Primary Examiner*—James T. McCall
*Attorney, Agent, or Firm*—William W. Haefliger

[57] ABSTRACT

A multi-purpose table comprises a. two frame sections having hinged interconnection, so that the sections are relatively swingable between two alternate positions, b. and means including a table top alternatively interfitting said sections in each of said positions thereof and characterized in that said sections support said table top at different elevations in said alternate positions.

8 Claims, 10 Drawing Figures

MULTI PURPOSE TABLE

BACKGROUND OF THE INVENTION

This invention relates generally to table constructions, and more particularly concerns a table having multiple use modes.

The invention meets the continuing need for a lightweight low-cost, table of simple construction and which provides for table top support at different elevations. Examples of the latter are dining level, coffee table level, and an intermediate level.

SUMMARY OF THE INVENTION

Basically, the table comprises:

a. two frame sections having hinged interconnection, so that the sections are relatively swingable between two alternate positions, b. and means including a table top alternately interfitting said sections in each of said positions thereof and characterized in that said sections support said table top at different elevations in said alternate positions.

As will be seen, the two sections are preferably symmetrically alike and have lightweight tubular construction of simple design; the hinged interconnection defines two longitudinal hinge axes parallel to two longitudinal tubular stretches which are hingedly interconnected; the tubular stretches defined by the sections in turn define multiple planes which may alternately be presented upwardly for supporting the table top in horizontal position; and the table top has shoulders which interfit the upwardly presented stretches to block horizontal displacement of the table top off the frame sections.

These and other objects and advantages of the invention, as well as the details of an illustrative embodiment, will be more fully understood from the following description and drawings, in which:

DRAWING DESCRIPTION

DETAILED DESCRIPTION

Figure 1:
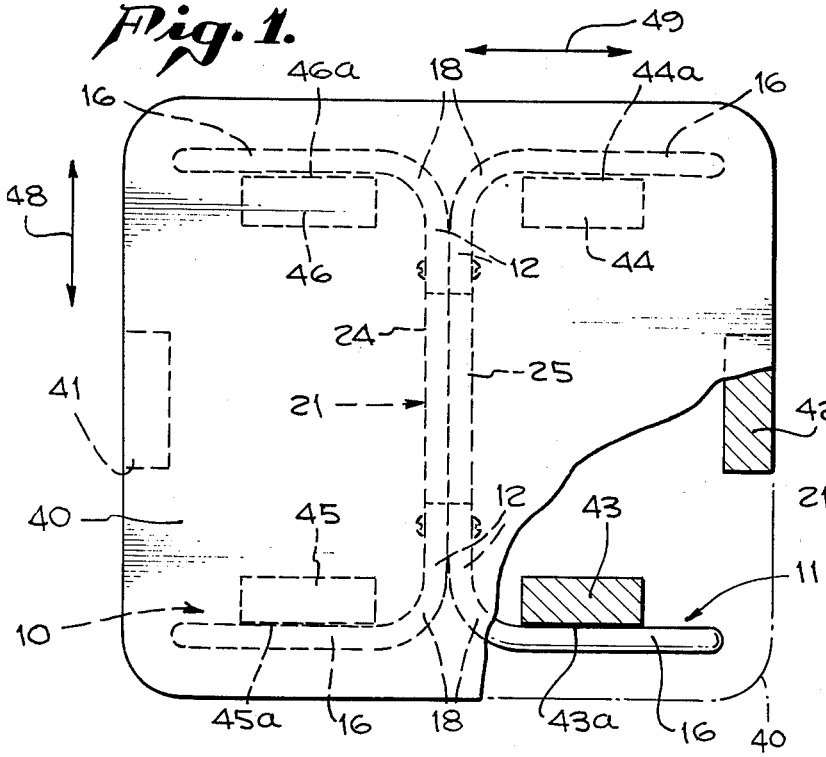
FIG. 1 is a plan view of the multi-purpose table, with the table top partially cut away.
Figure 4:
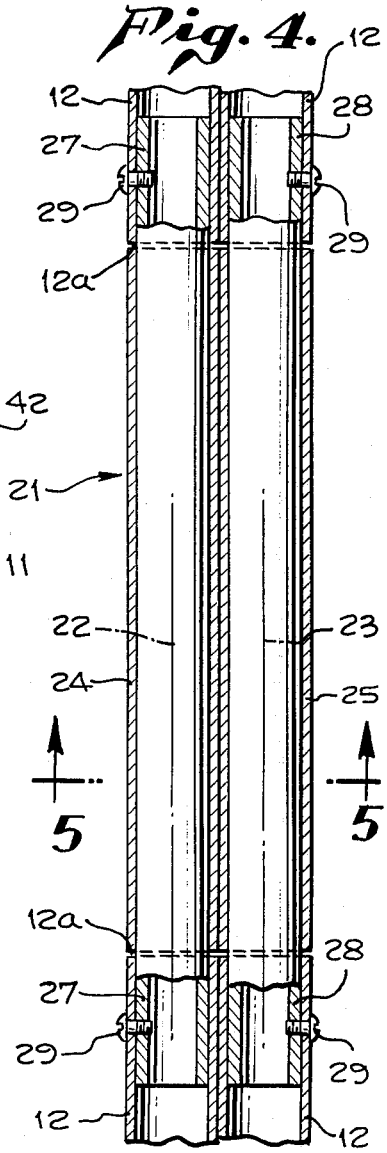
FIG. 4 is an enlarged fragmentary plan view of a hinge portion of the frame, taken on lines 4—4 of FIG. 2.
Figure 2:
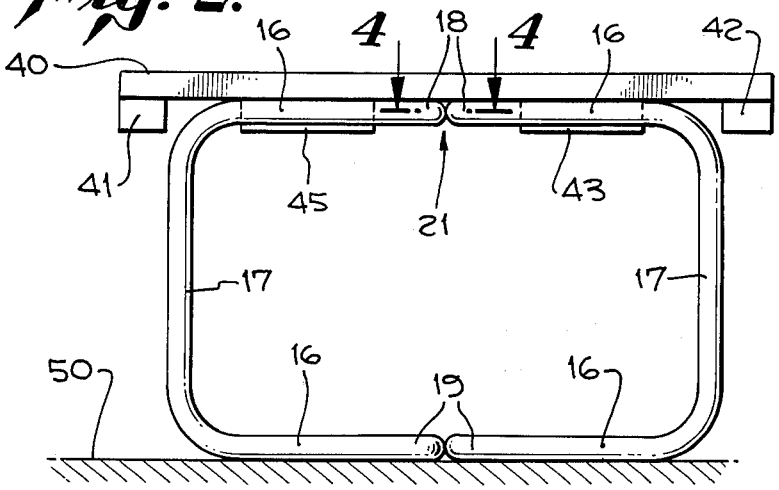
FIG. 2 is a side elevation of the FIG. 1 table.
Figure 3:
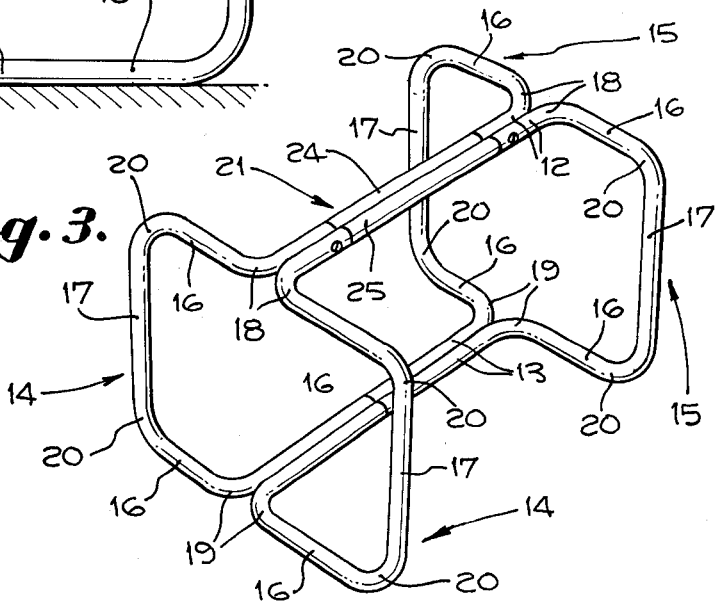
FIG. 3 is a perspective showing of the table frame in FIG. 1 position.
Figure 5:
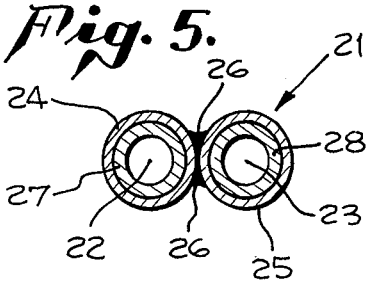
FIG. 5 is a section on lines 5—5 of FIG. 4.

In FIGS. 1–3, two frame sections, as for example appear at 10 and 11, have hinged interconnection so that the sections are swingable between two alternate positions. In the example, the sections are swingable between the positions represented in FIGS. 3 and 9, and it is clear that they are symmetrically alike and comprise tubing stretches. Each section may, with unusual advantage, include two parallel tubing stretches 12 and 13 extending longitudinally, and two U-shaped stretches 14 and 15, each defined by two lateral stretches 16 and a cross-piece stretch 17 interconnecting the lateral stretches. The ends of stretches 16 merge with the ends of stretches 12 and 13 at curved portions 18 and 19; likewise, the ends of the cross-piece 17 merge with the ends of the lateral stretches 16 at curved portions 20.

The hinged interconnection, generally indicated at 21, may with unusual advantage define two longitudinal hinge axes 22 and 23 parallel to the two tubular stretches 12 which are hingedly interconnected. In this regard, the simple and effective hinge interconnection may comprise two hinge sleeves 24 and 25 joined together as by welds 26, and defining axes 22 and 23, respectively; and hinge pins 27 and 28 coaxially received by the sleeves. The stretches 12 receive the end portions of the pins and are suitably connected thereto, as by fasteners 29, to pivot therewith about axes 22 and 23. The stretches 12 define terminals 12*a* extending in end-to-end relation with the sleeves, as shown. The sleeves and the stretches 12 have the same diameter so that the sleeves appear to be longitudinal continuation of the stretches 12.

Figure 6:
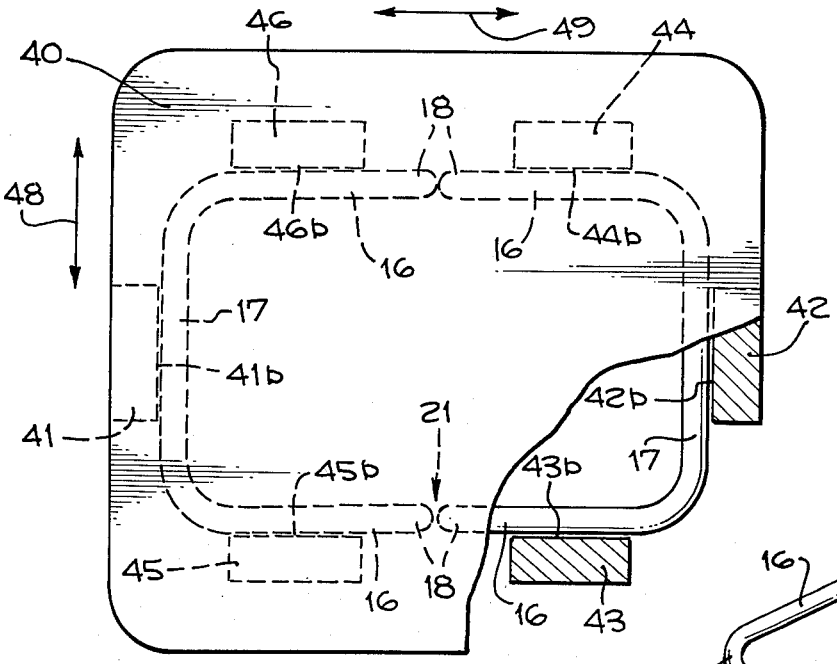
FIG. 6 is another plan view of the table, with the table top partially cut away, and showing the frame in a second position.
Figure 8:
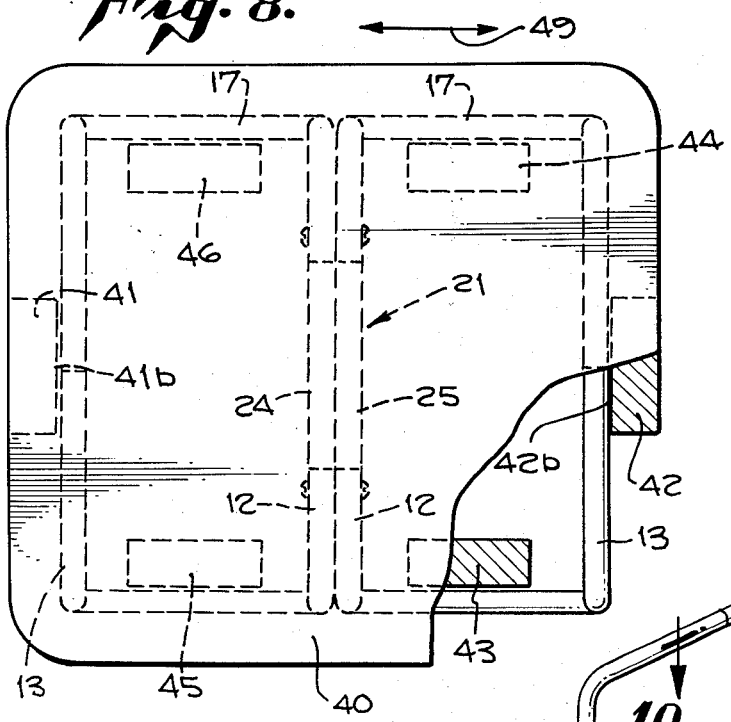
FIG. 8 is yet another plan view of the table, with the top partially cut away, and showing the frame in a third position.

The table also includes a table top interfitting and supported by the two frame sections 10 and 11 in each of its alternate positions, as shown in FIGS. 1, 6 and 8. For example, the table top may comprise a panel 40 having blocks 41–46 attached thereto at its underside, to present shoulders 41*a*–46*a* to interfit the uppermost stretches of the sections, in each of the alternate positions. In FIG. 1, block shoulders 43*a*–46*a* interfit uppermost stretches 16 at their inner sides, to limit horizontal displacement of the table top in directions indicated by arrows 48. The blocks are also engageable with the inner sides of corner portions 18 of the stretches to limit horizontal displacement of the table top in directions indicated by arrows 49.

In FIG. 6, the inner sides 41*b*–46*b* of the blocks 41–46 are engageable with stretches 16 and 17, as shown, to limit horizontal displacement of the table top in directions 48 and 49. In FIG. 8, the inner sides 41*b* and 42*b* of the blocks 41 and 42 are engageable with stretches 17, as shown, to limit horizontal displacement of the table top in directions 49.

Figure 7:
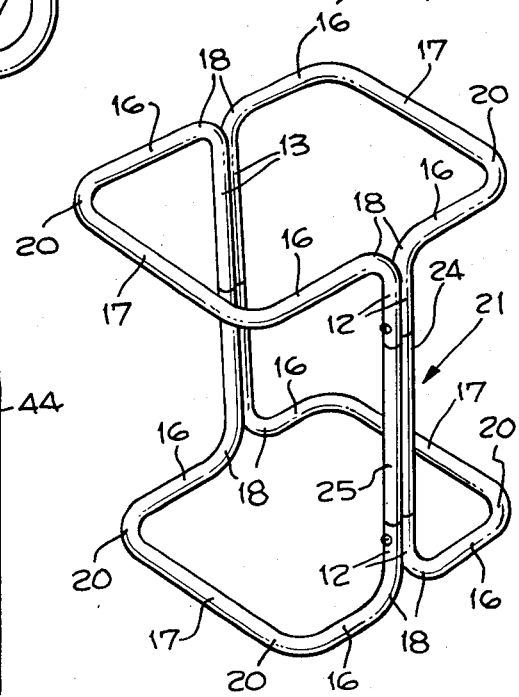
FIG. 7 is a perspective showing of the table frame in FIG. 6 position.
Figure 9:
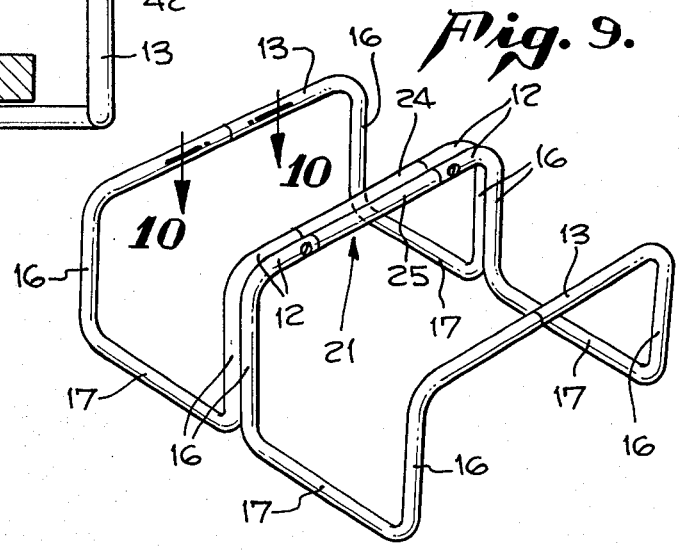
FIG. 9 is a perspective showing of the table frame in FIG. 8 position.
Figure 10:
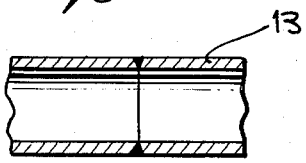
FIG. 10 is a section on lines 10—10 of FIG. 9.

Note that the table top has its highest elevation in FIGS. 6 and 7, its lowest elevation in FIGS. 8 and 9, and an intermediate elevation in FIGS. 1–3. Also, in FIGS. 1–3 the stretches 12 and 16 of the sections in one of their two positions define an upwardly facing plane to receive the table top; and in FIGS. 8 and 9 the stretches 12 and 17 of the sections in said one position thereof define another upwardly facing plane to receive the table top. In FIGS. 6 and 7 the stretches 16 and 17 define a third plane which faces upwardly, the sections having the same relative position as in FIGS. 1–3, i.e. with stretches 17 interengaged. In FIGS. 8 and 9, certain of the stretches 16 of the two sections are interengaged.

Also, in FIGS. 1–3, lowermost stretches 16 and 13 support the frame sections on floor 50; in FIGS. 6 and 7, lowermost stretches 16 and 17 support the frame sections on the floor; and in FIGS. 8 and 9, lowermost stretches 17 support the frame sections on the floor. Finally, as seen in FIGS. 3 and 9, the cross-piece stretches 17 define a common plane in a first position (FIG. 9) and two longitudinally spaced parallel planes in a second position (FIGS. 3 and 7).

I claim:

1. In a multi purpose table, the combination comprising a. two like, symmetrical frame sections having hinged interconnection, so that the sections are relatively swingable between two alternate positions, said sections comprising tubular stretches, b. and means including a table top alternatively interfitting said sections in each of said positions thereof and characterized in that said sections support said table top at different elevations in said alternate positions, c. each section including two longitudinal stretches and two U-shaped stretches each defined by two lateral stretches and a cross-piece stretch interconnecting the two lateral stretches, the two lateral stretches merging with adjacent ends of the two longitudinal stretches, the cross-piece stretches defining a common plane in a first of said two positions, and defining two longitudinally spaced parallel planes in a second of said two positions.

2. The combination of claim 1 wherein said hinged interconnection defines two longitudinal hinge axes parallel to two of said tubular stretches which are hingedly interconnected.

3. The combination of claim 2 wherein said hinge axes extend generally vertically in one of said positions, and horizontally in another of said positions.

4. The combination of claim 3 wherein said sections define two planes one of which faces upwardly in one of said positions and another of which faces upwardly in said other position of the sections.

5. The combination of claim 4 wherein said sections define a third plane which faces upwardly in one of said two positions of the sections, the table top seated on and interfitting the sections when said third plane faces upwardly, at which time said hinge axes also extend horizontally.

6. The combination of claim 2 wherein said hinge interconnection is defined by two integrally connected sleeves which are in alignment with said two stretches, respectively, and two pins received through the sleeves, the stretches respectively attached to the pins.

7. The combination of claim 1 wherein the table includes a table top interfitting and supported by the sections in each of said positions.

8. The combination of claim 5 wherein the table includes a table top having shoulders at its underside to interfit the uppermost stretches of the sections in each of said positions.

* * * * *